US010196884B2

(12) United States Patent
Li et al.

(10) Patent No.: US 10,196,884 B2
(45) Date of Patent: Feb. 5, 2019

(54) METHOD FOR ENHANCING OIL RECOVERY IN HUFF-PUFF OIL PRODUCTION OF TIGHT OIL FROM A FRACTURED HORIZONTAL WELL

(71) Applicant: PetroChina Company Limited, Dongcheng District, Beijing (CN)

(72) Inventors: Zhongxing Li, Beijing (CN); Jiyong Zhao, Beijing (CN); Xuefeng Qu, Beijing (CN); Qihong Lei, Beijing (CN); Youan He, Beijing (CN); Wubin Gao, Beijing (CN); Wantao Liu, Beijing (CN); Xuanru Wang, Beijing (CN); Wenlong Chen, Beijing (CN); Guoxi Zhao, Beijing (CN)

(73) Assignee: Petrochina Company Limited, Beijing (CN)

( * ) Notice: Subject to any disclaimer, the term of this patent is extended or adjusted under 35 U.S.C. 154(b) by 0 days.

(21) Appl. No.: 15/582,796

(22) Filed: May 1, 2017

(65) Prior Publication Data

US 2017/0314377 A1 Nov. 2, 2017

(30) Foreign Application Priority Data

Apr. 29, 2016 (CN) ..... 2016 1 0282642

(51) Int. Cl.
*E21B 43/20* (2006.01)
*E21B 43/16* (2006.01)
*E21B 47/06* (2012.01)

(52) U.S. Cl.
CPC ..... *E21B 43/20* (2013.01); *E21B 47/06* (2013.01)

(58) Field of Classification Search
CPC ..... E21B 43/16; E21B 43/305; E21B 43/20
See application file for complete search history.

(56) References Cited

U.S. PATENT DOCUMENTS 4,022,280 A * 5/1977 Stoddard
4,034,812 A 7/1977 Widmyer
(Continued)

FOREIGN PATENT DOCUMENTS

CN 1297099 A 5/2001
CN 104408541 A 3/2015

OTHER PUBLICATIONS

Wang, Pingping et al; Researching on the formation energy supplement of an 83 Chang 7 tight oil reservoir of Hujianshan oilfield; Petrochemical Industry Application, vol. 34, No. 3, p. 58-62; Mar. 2015; Ningxia Chemical Industry Society, Ningxia, China.
(Continued)

*Primary Examiner* — Catherine Loikith
(74) *Attorney, Agent, or Firm* — Harness, Dickey & Pierce, P.L.C.

(57) ABSTRACT

A method for enhancing oil recovery in huff-puff oil production of tight oil from a fractured horizontal well by an optimized reservoir pressure, washing the horizontal well by sand flushing, injecting water into the reservoir to increase the stratum pressure around the horizontal well, and stopping the water injection when the pressure retention level is 100% at end stage of the water injection period. The method for enhancing oil recovery in huff-puff oil production of tight oil from a fractured horizontal well enables the crude oil in the pores of the matrix in the tight reservoir rock developed by the natural fracture to be further recovered. Comprehensive utilization of stratum energy boost, and imbibition replacement between the injected water and the reservoir crude oil improves the single-well production to enhance the oil recovery of a tight oil reservoir.

9 Claims, 12 Drawing Sheets

(56) References Cited

Figure 1:
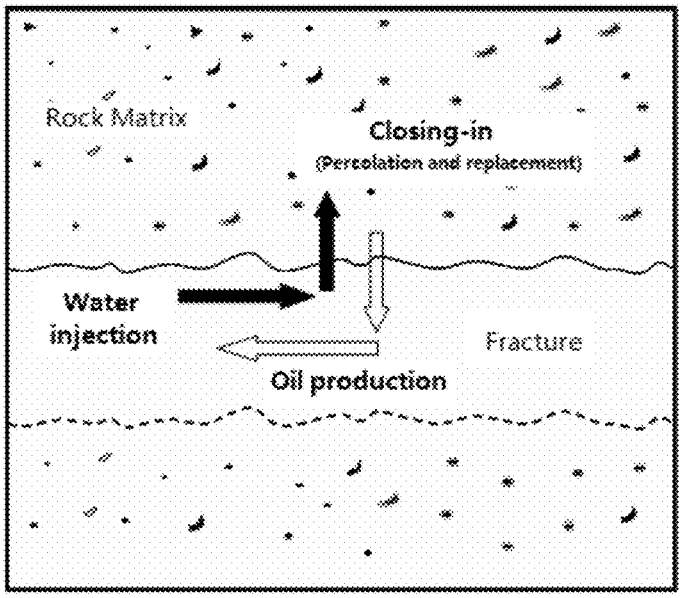

U.S. PATENT DOCUMENTS 5,411,086 A 5/1995 Burcham et al.
6,814,141 B2 * 11/2004 Huh

OTHER PUBLICATIONS

Dazhi, Huang et al; Study of Oil Production Mechanism of Water Injection; Petroleum Geology; Oct. 2004; vol. 11, period 5; Shengli Oilfield Ltd Co., Shandong, China.
Ren, Long; Numerical Simulation Applied Technological Research of Chang7 Super-Low Permeability Reservoir Water Injection Development; Xi'an Shiyou University Master's Thesis; May 20, 2012; pp. 30-67; Xi'an Shiyou University, Shaanxi, China.
Jiqiang, Li et al; Method of Recovery Ratio for No Energy Complement Wells in South Yellow River Region; Oil & Gas Geology; Sep. 2001; pp. 221-224; V 22, 3; Sinopec Group, Beijing, China.
Kou, Xianming et al; Study on Oil—Adding Mechanism of Water Injection in Single Well of Tahe Carbonate Reservoir; Well Testing; Apr. 2013, p. 10-12, V 22, 2; Huabei Petroleum Admin, Hebei, China.

* cited by examiner

METHOD FOR ENHANCING OIL RECOVERY IN HUFF-PUFF OIL PRODUCTION OF TIGHT OIL FROM A FRACTURED HORIZONTAL WELL

CROSS-REFERENCE TO RELATED APPLICATIONS

This application claims priority to Chinese Patent Application No. 201610282642.4, filed on Apr. 29, 2016, which is hereby incorporated by reference in its entirety.

FIELD

The present invention is directed to the field of oil extraction from a well and, in particular, to a method for enhancing oil recovery in huff-puff oil production of tight oil from a fractured horizontal well.

BACKGROUND

Tight oil is the abbreviation of tight reservoir oil, the main storage space of which are unconventional reservoirs such as tight sandstone, marl, dolomite or shale. At present, tight oil has been commercialized in North America and has brought great changes to the world oil and gas exploration and extraction, which is gradually affecting the pattern of world energy supply and demand. China's tight oil is mainly land-based, with great resource potential, and widely distributed, mainly in Songliao, Qaidam, Ordos and Sichuan Basin. At present, with the decreased number of newly discovered conventional oil fields and the gradual reduction of recoverable reserves of oil and gas resources, tight oils will be one of the major oil and gas resources in the future. However, the tight oil reservoir has the characteristics such as low porosity, low permeability and low pressure, accompanied by the development of natural microfractures, thus has defects such as difficult development and energy supplement, and low degree of use. At present, the volume fractured horizontal well production process is widely used in the extraction of tight oil. Due to the presence of natural microfractures, conventional waterflooding extraction can easily cause water logging of the horizontal well. Other extraction methods such as gas flooding, chemical flooding have expensive operation cost and poor extraction effect. Therefore, there is need to find out an oil reservoir extraction process which is economic and reasonable.

Huff-puff oil extraction technology is a kind of production process for performing injection and production in the same well and oil reservoir layer, which has two important oil production mechanism, with the first to enhance the stratum energy around the oil well, and the second to reduce crude oil saturation in reservoir micropores using the flooding characteristics of the injection agent. As an effective method for enhancing oil recovery, the huff-puff technology is widely used in experimental development. However, there are a variety of types of huff-puff technologies, including $CO_2$ huff-puff, microbial huff-puff, steam huff-puff and water huff-puff, of which the adaptive reservoir characteristics and mechanism of action are not the same. Therefore, a huff-puff oil production method suitable for the extraction of tight oil must be found.

In the tight oil reservoir modified by using the volume fracturing process, under the large displacement (>6 $m^3$/min) conditions, a large number of fracturing liquid (single-stage fracturing liquid injection volume >800 $m^3$) is pressure injected into the reservoir, and proppants with high flow conductivity are added for crack support, forming complex, seam-type artificial fractures having flow conductivity hundreds of times larger than that of matrix. At the same time, the complex artificial fractures formed after multi-stage fracturing in the horizon section of horizon well communicate a large number of natural fractures in the reservoir, so that the number of effective fractured seepage channels for flowing the reservoir crude oil into the bottom of the well is increased, expanding the area of the seepage. Under such characteristics of the reservoir seepage, it is very easy to form gas channeling or flooding and thus reduce the oil production capacity of the oil well when the gas injection or water injection is carried out in the adjacent injection wells. However, the use of a method for enhancing oil recovery in huff-puff oil production in a same horizontal well effectively solve the problem of gas channeling or water logging; meanwhile, relying on the complex seam-type fractures in the reservoir fractures, the effective area of huff-puff is greatly expanded, and the effect of huff-puff is increased.

Huang Dazhi (Study on oil production mechanism of waterflood huff-puff. Petroleum Geology and Recovery Efficiency, 2004, 11 (5): 39-41) introduces that the huff-puff oil production by water injection refers to an oil production method, wherein water is injected into production layer, with the injected water preferentially fill favorable parts such as high porosity and high permeability zone and large pore throat or fractures; after the well is shut down, under the action of capillary force, the injected water is replaced with the crude oil in the medium, small pore throats or the matrix, resulting in redistribution of oil and water in the production layer, then the well is opened to decrease pressure, and the replaced oil is taken out together with the injected water (see FIG. 1).

The advantages of waterflood huff-puff lie in that, it can effectively improve the water logging in fractures during the waterflood extraction of fracture reservoir; meanwhile it can improve oil recovery by making full use of oil and water imbibition replacement and stratum energy supplement principle. In addition, the injection agent (injected water) is low in price, adequate in resources, and low in operating costs. For high-input-cost extraction for tight oil, in the volume fractured horizontal wells, the implementation of water injection can rely entirely on seam-type fractures, which expands the contact area of injected water and the fractures, and further increases the amount of oil and water replacement. At the same time, after alternately repeated water injection and oil production process, the swept area of oil washing and displacement multiple are increased, the efficiency of oil displacement is improved, thereby the oil recovery is enhanced.

At present, the home and abroad research on waterflood huff-puff is focused on the development of straight wells, but less directed to the waterflood huff-puff in the horizontal wells, and there is no study on huff-puff oil production of tight oil from a volume fractured horizontal well in the unconventional reservoirs. At present, the kind of reservoirs is mainly developed by natural energy failure. In this method, the energy of the stratum is reduced rapidly, the yield is decreasing rapidly, the final recovery rate is low, and the economic benefit development of the reservoir cannot be realized. Therefore, for the tight oil reservoir extraction from the fractured horizontal well, it still needs further in-depth exploration of better extraction methods. In addition, for the waterflood huff-puff technology, theoretical analysis and experiments on how the parameters such as water injection amount, water injection speed, shut-down time, oil production time, and oil production speed influence the oil production efficiency of the waterflood huff-puff have not been clearly understood.

SUMMARY

In order to overcome the problem of low recovery rate of the natural energy failure type extraction in the current development of fractured horizontal wells in the tight oil reservoirs, the present invention provides a method for enhancing oil recovery in huff-puff oil production of tight oil from a fractured horizontal well. The invention improves the imbibition and oil displacement effect of the fractured tight oil reservoir, improves the infiltration capacity of the low permeability reservoir fractures with the matrix, and increases the recovery degree of the crude oil. It utilizes the horizontal well subjected to the volume fracturing to perform the huff-puff production of tight oil reservoir, fully increases the oil-water contact area in the artificial fractures and natural fractures, and further improves the imbibition and production-enhancing effect of the overall reservoir.

The technical solution for achieving the object of the present invention is:

A method for enhancing oil recovery in huff-puff oil production of tight oil from a fractured horizontal well, having the following specific steps:

1) when the reservoir pressure is reduced to 10 MPa, washing the horizontal well by sand flushing, then injecting water into the reservoir with the specified daily water injection amount to increase the stratum pressure around the horizontal well, and stopping the water injection when the pressure retention level is 100% at end stage of the water injection period, with the cumulative water injection amount at this time equal to the cumulative liquid recovery amount of the same well in a former production stage;

2) after the completion of water injection, shutting down the horizontal well and starting the huff-puff process of the horizontal well in the reservoir so as to initiate the well-closing stage in which the reservoir crude oil enters the high-permeability channels relying on the imbibition replacement effect;

3) opening the well and starting oil extraction, and shutting down the well when the stratum pressure in the control area of the horizontal well drops to the rated pressure, to perform the second cycle of water injection, well-closing and oil extraction process.

The reservoir is a single-layer reservoir with a thickness of 2-100 m; the reservoir is a tight, natural microfracture-developed reservoir; the reservoir matrix has an average permeability of less than 0.3 mD, an average porosity of 9% and an average fracture density of 0.29/m; the reservoir is a type of an unsaturated, low pressure reservoir with no bottom water/gas top.

The well of the reservoir is a horizontal well with a horizontal section of 850 m and a well spacing of 600 m; the well is a well subjected to sectional volume fracturing modification and having an average fracture construction displacement of >6 $m^3$/min, and an average fractured section interval of 80-100 m, when the well is completed and casing cemented.

The pressure at the end of the oil extraction in step 3) is 10 MPa and the pressure retention level is 59%.

In step 1), in the water injection stage, the daily water injection amount, as obtained from numerical simulation studies and mineral experiment analysis, is a single-section daily water injection amount of 10-20 $m^3$, and the single-well daily water injection amount is the sum of each single-section daily water injection amount.

In step 1), according to the material balance principle, the cumulative injection amount is the elastically changed volume of the pores in the stratum, and the cumulative water injection amount as calculated at the time when the pressure retention level rises from a low level before the huff-puff to 100% is a cumulative water injection amount for a single huff-puff cycle.

In step 2), in the huff-puff process of the horizontal well in the tight oil reservoir, the well-closing time is 30 days.

In step 3), because of high water content at the initial stage of the well opening and oil extraction, the initial-stage production is conducted by controlling the liquid with a daily liquid volume of not exceeding 15 $m^3$ to reduce energy loss.

The cycle of water injection, well-closing and oil extraction process is repeated for 1-5 times.

The beneficial effects of the present invention are:

through the research on the extraction by waterflood huff-puff in the tight oil fracturing horizontal well, the present invention provides an effective way to increase oil recovery for the extraction of tight oil; at the same time, the method for huff-puff oil production of tight oil from a fractured horizontal well has an significant yield-enhancing effect, a low investment cost, a good economic benefit, and a much lower technical and economic risk than that of gas huff-puff, microbial huff-puff or chemical huff-puff.

DRAWINGS

FIG. 1: A schematic diagram of the replacement process between reservoir fractures and the matrix in the huff-puff process.

Figure 2:
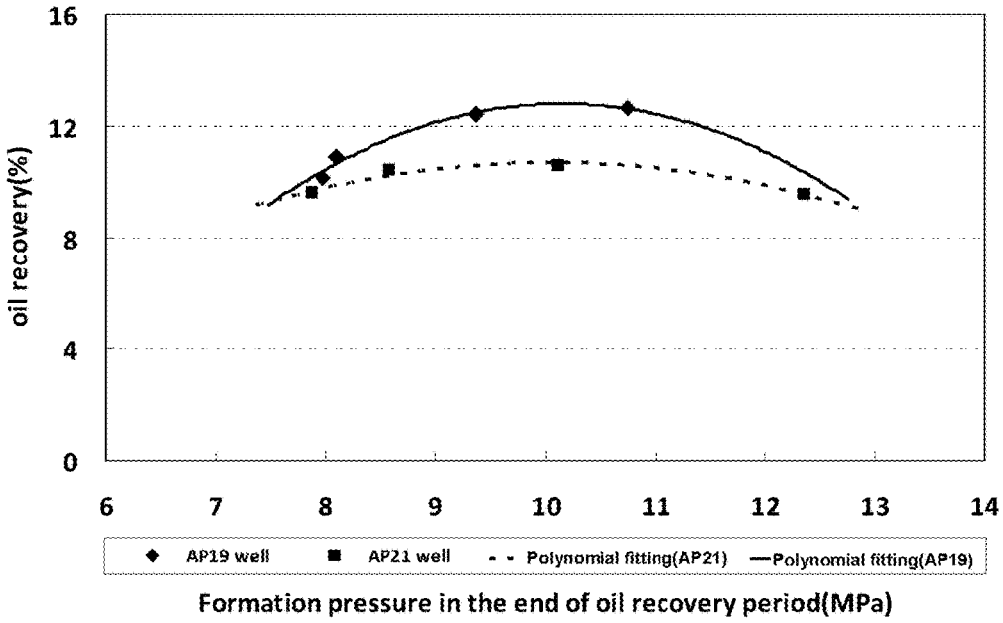

FIG. 2: A graph of the relationship between the recovery degree and the pressure at the end of oil extraction after multiple cycles of huff-puff.

Figure 3:
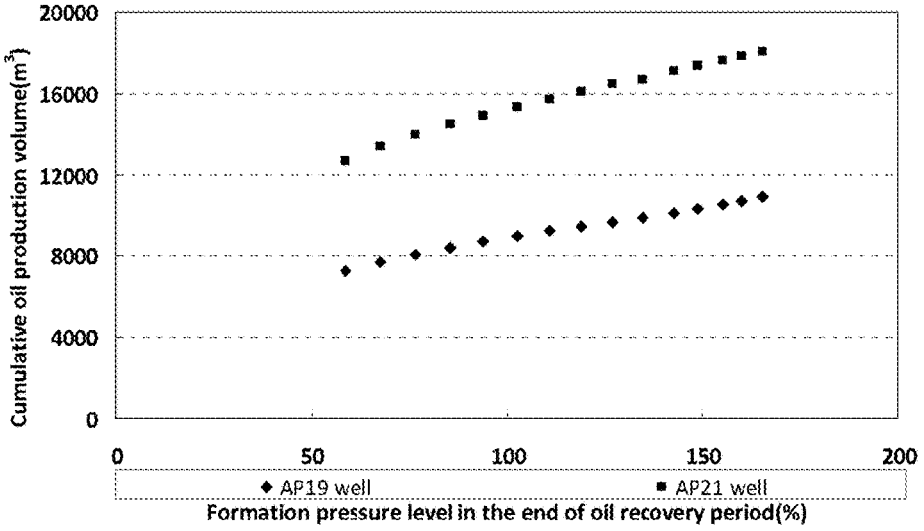

FIG. 3: A graph of the relationship between cumulative oil production and pressure retention level.

Figure 4:
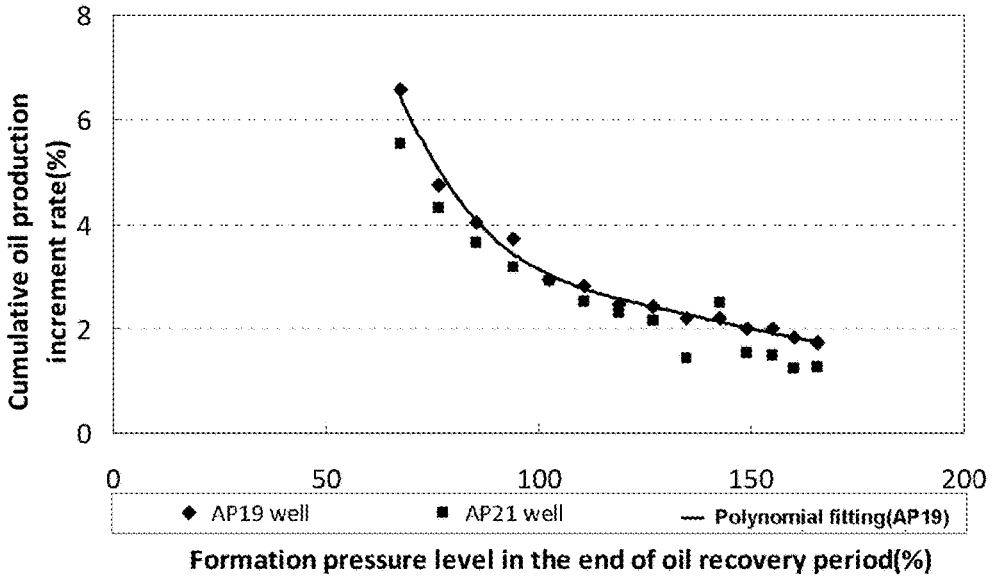

FIG. 4: A graph of the relationship between cumulative oil production increasing rate and pressure retention level.

Figure 5A:
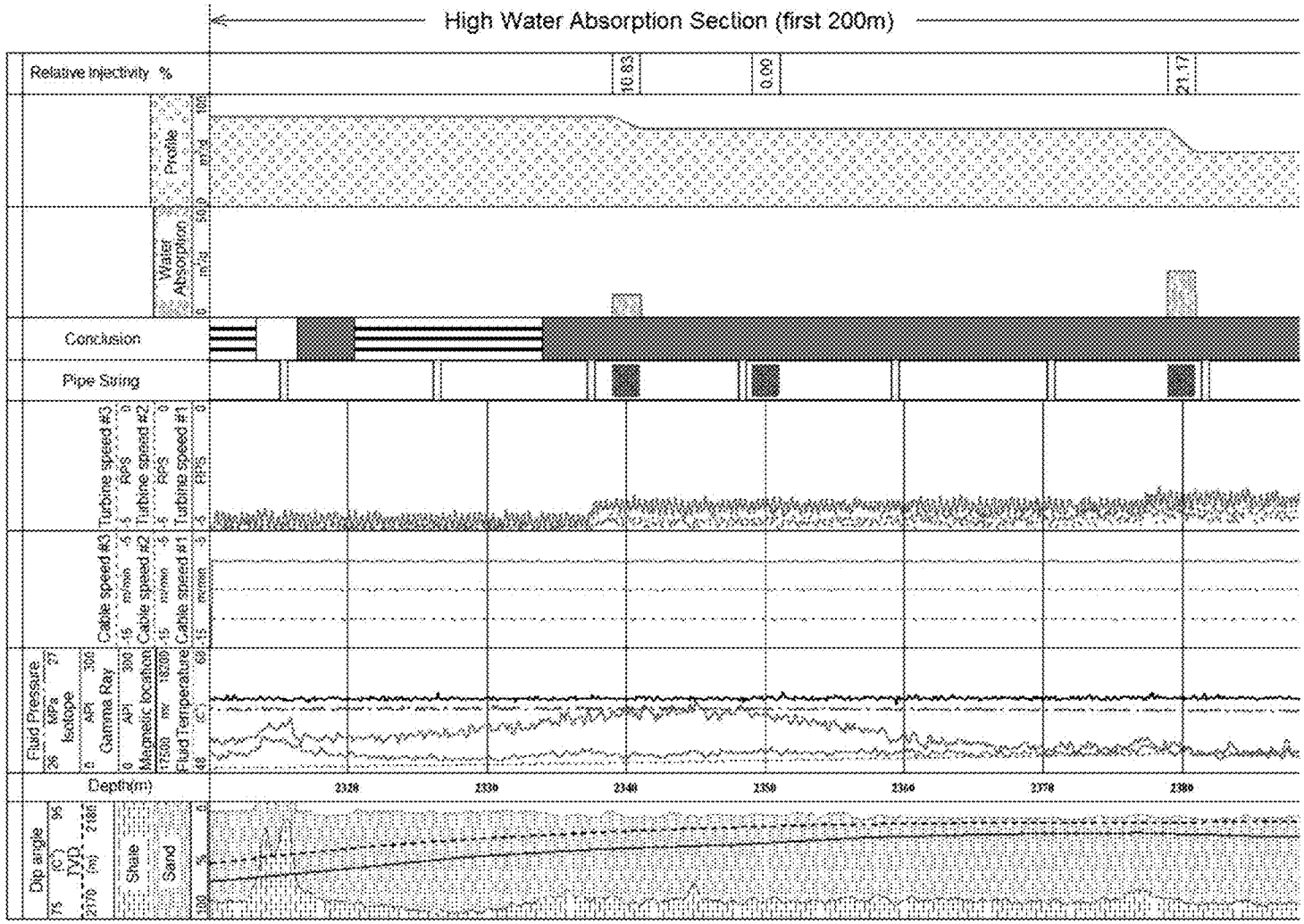

FIG. 5A: A cross-section profile for water absorption of Anping No. 19 well.

Figure 5B:
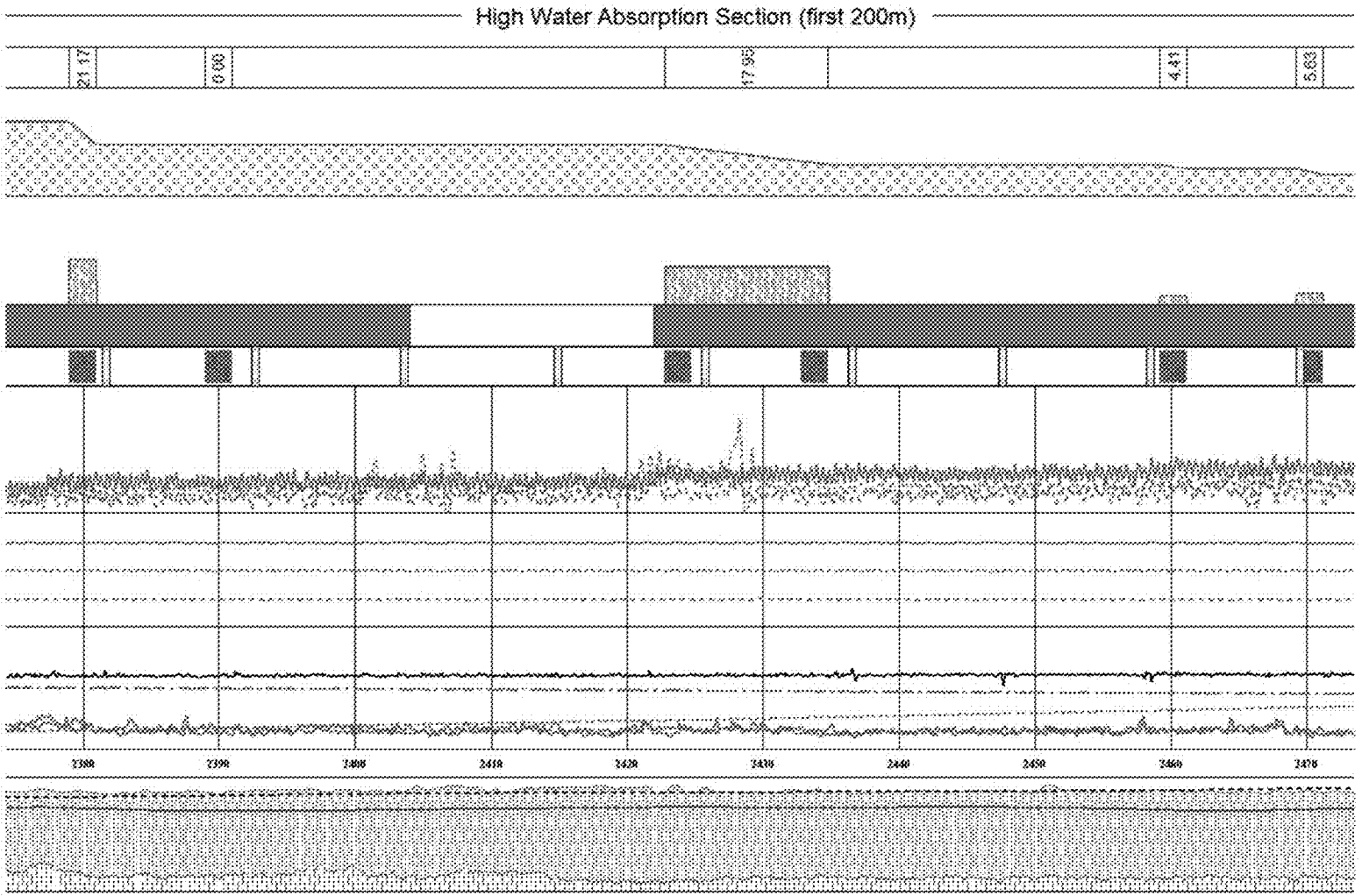

FIG. 5B: Extension of the cross-section profile for water absorption of Anping No. 19 well.

Figure 5C:
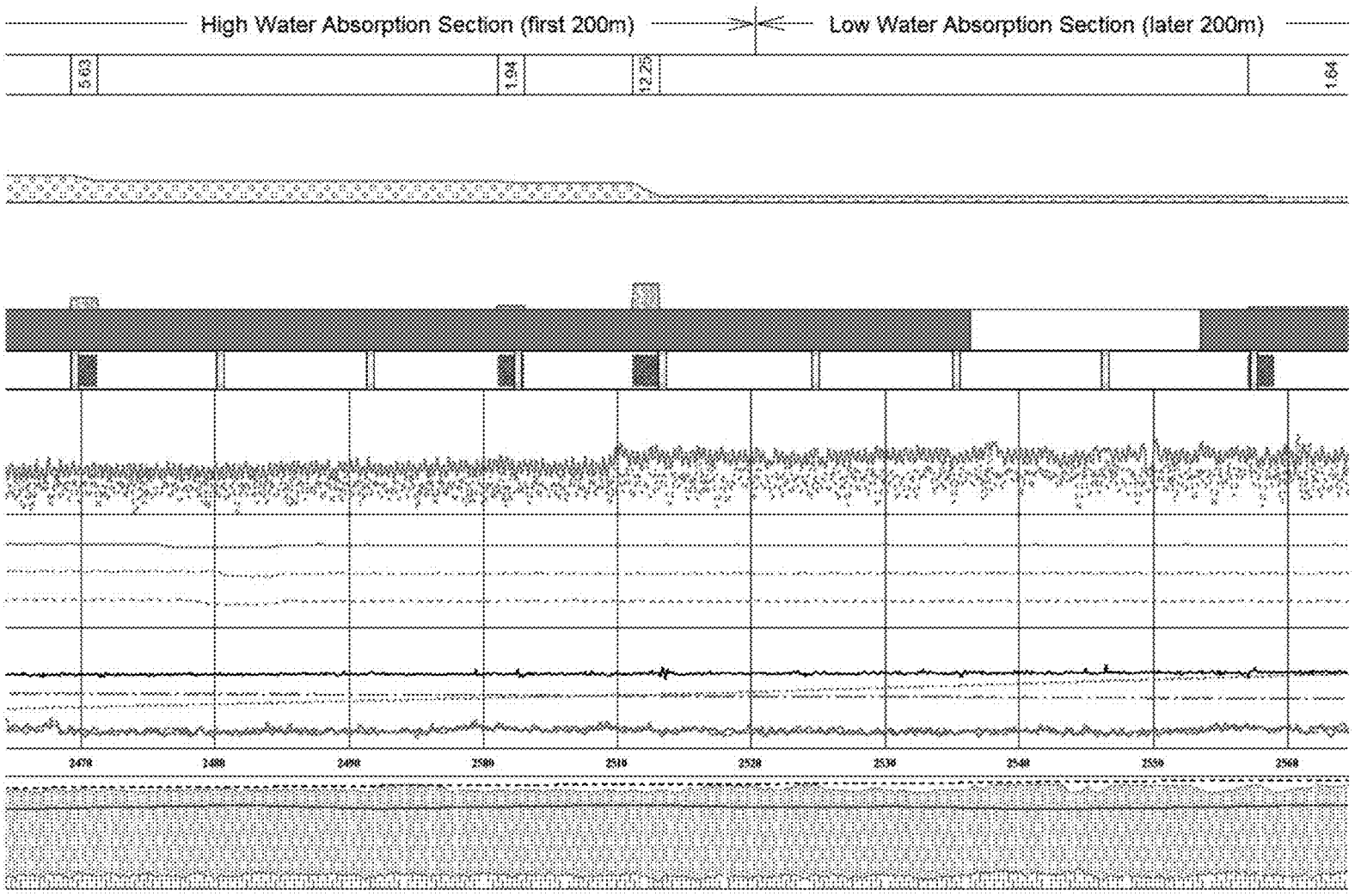

FIG. 5C: Continued extension of the cross-section profile for water absorption of Anping No. 19 well.

Figure 5D:
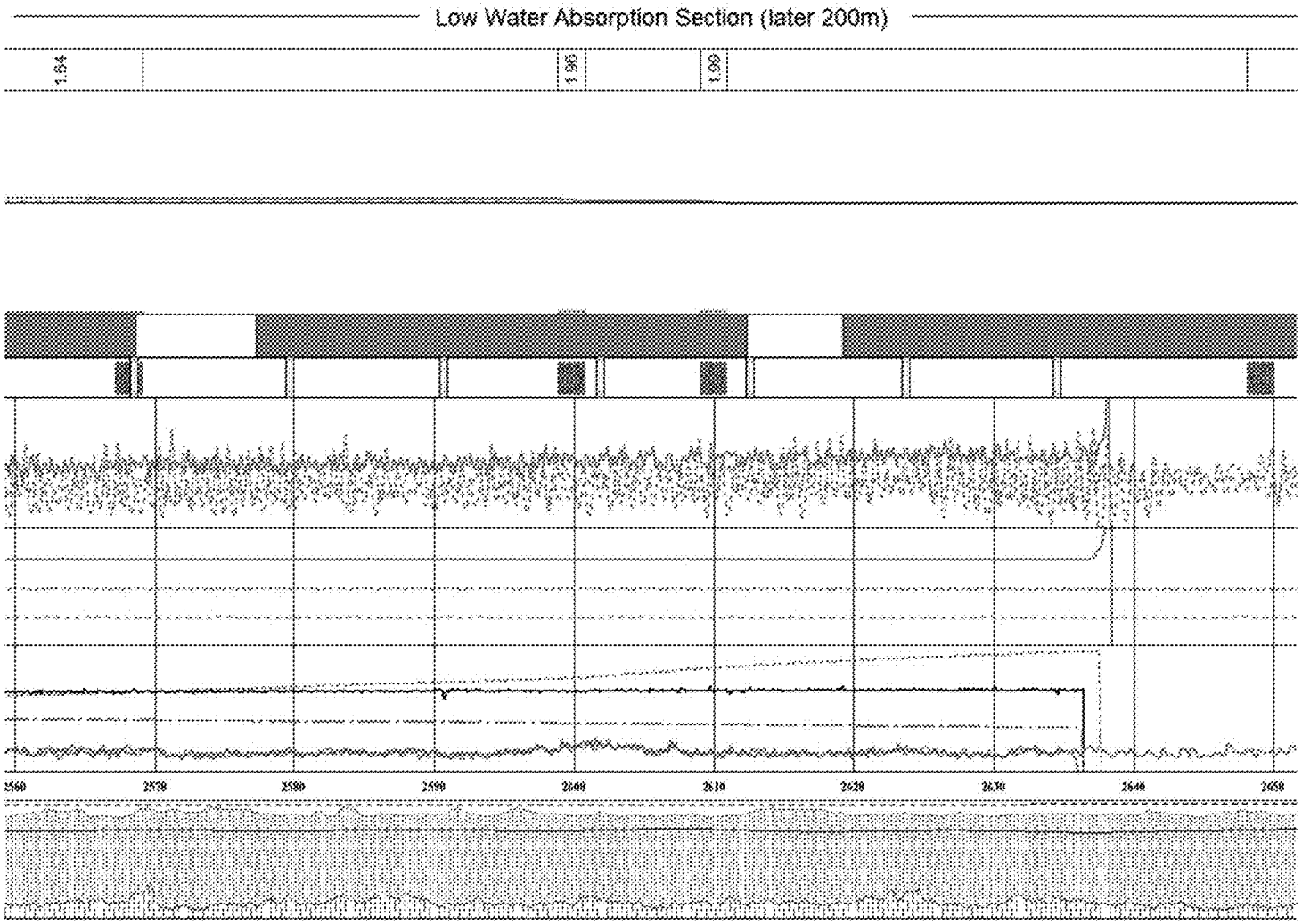

FIG. 5D: Continued extension of the cross-section profile for water absorption of Anping No. 19 well.

Figure 5E:
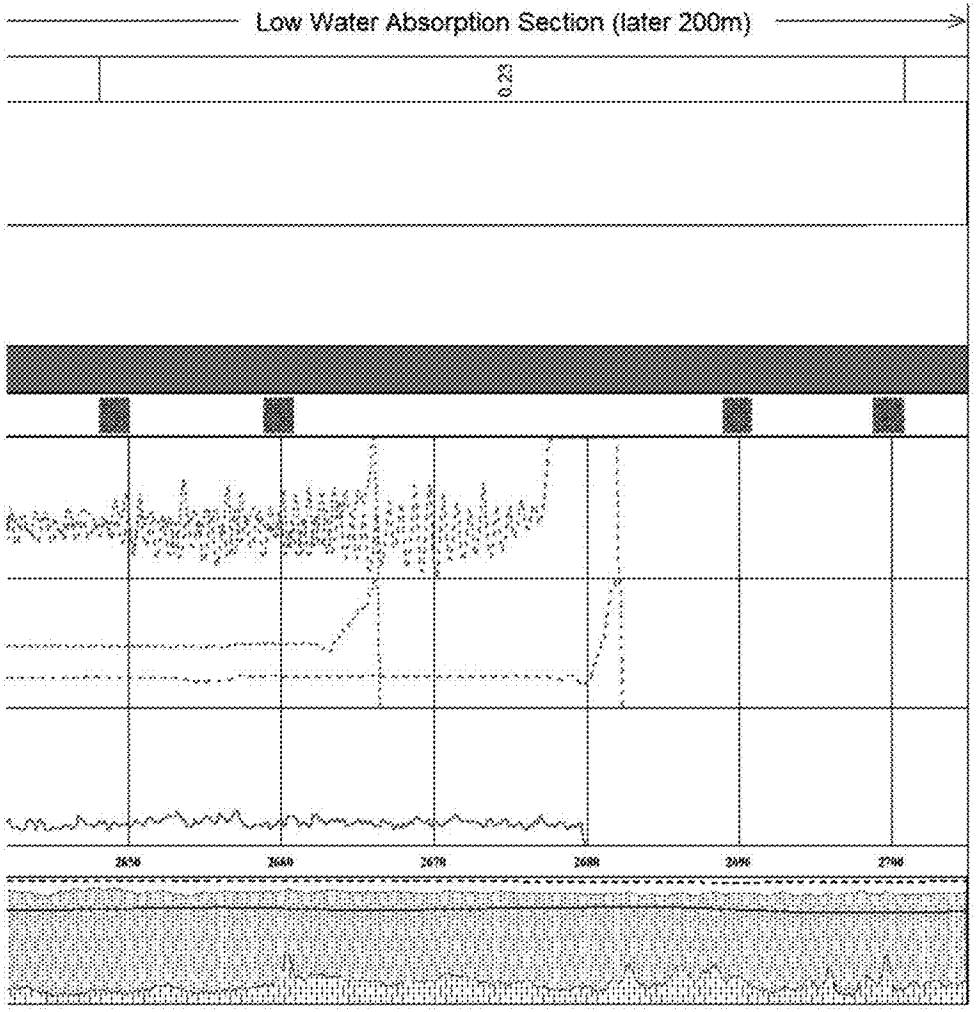

FIG. 5E: Continued extension of the cross-section profile for water absorption of Anping No. 19 well.

Figure 6:
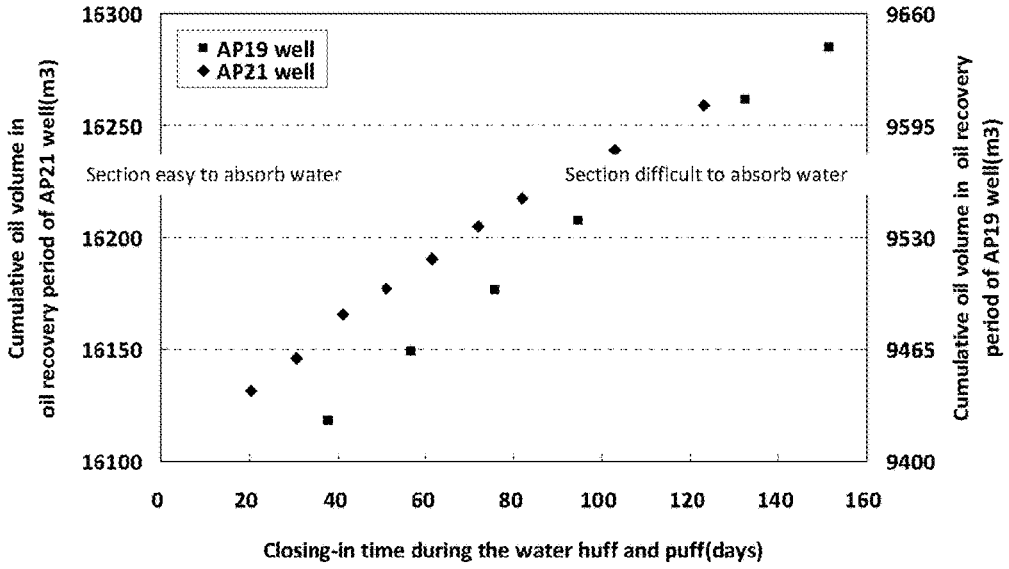

FIG. 6: A graph of the relationship between the cumulative production and the well-closing time.

Figure 7:
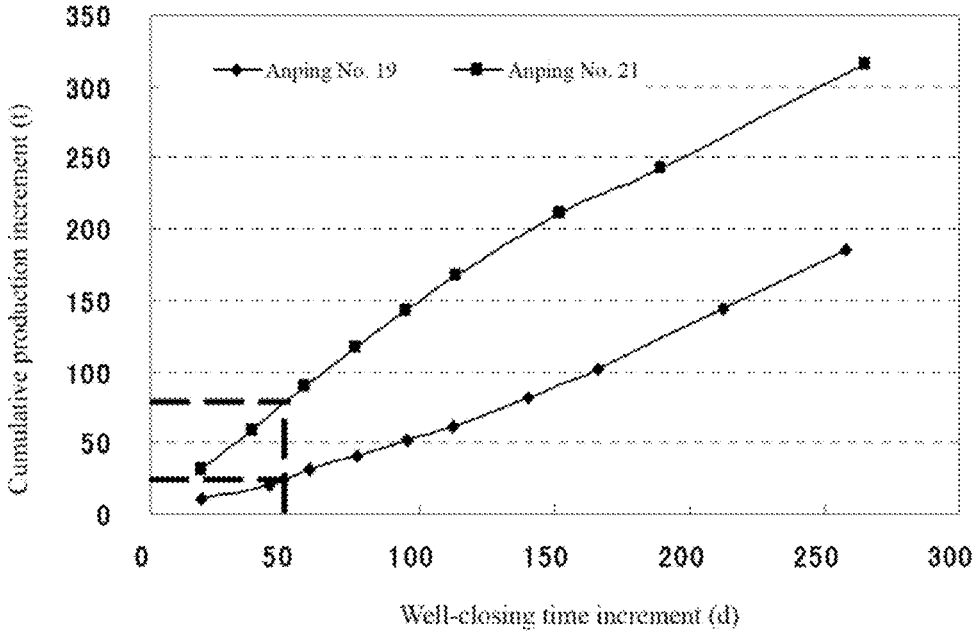

FIG. 7: A graph of the relationship between the cumulative oil production increment and the well-closing time increment.

Figure 8:
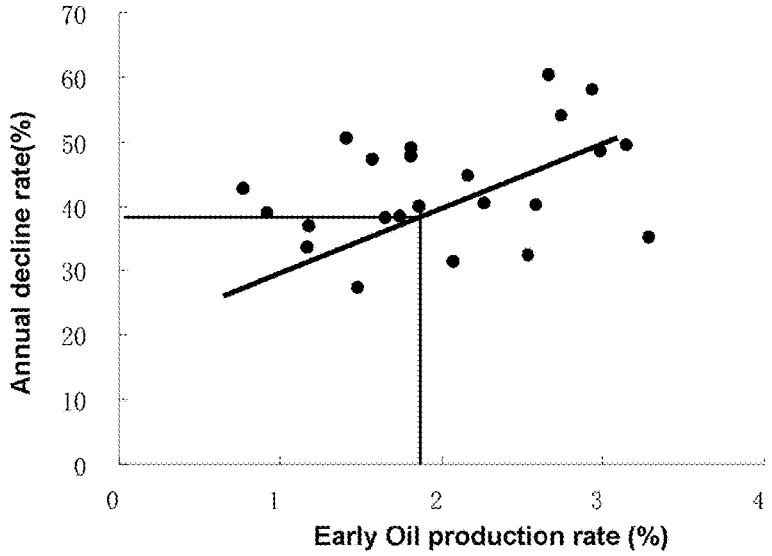

FIG. 8: A graph of the relationship between initial oil production rate and the annual decline of An 83 tight oil block.

Figure 9:
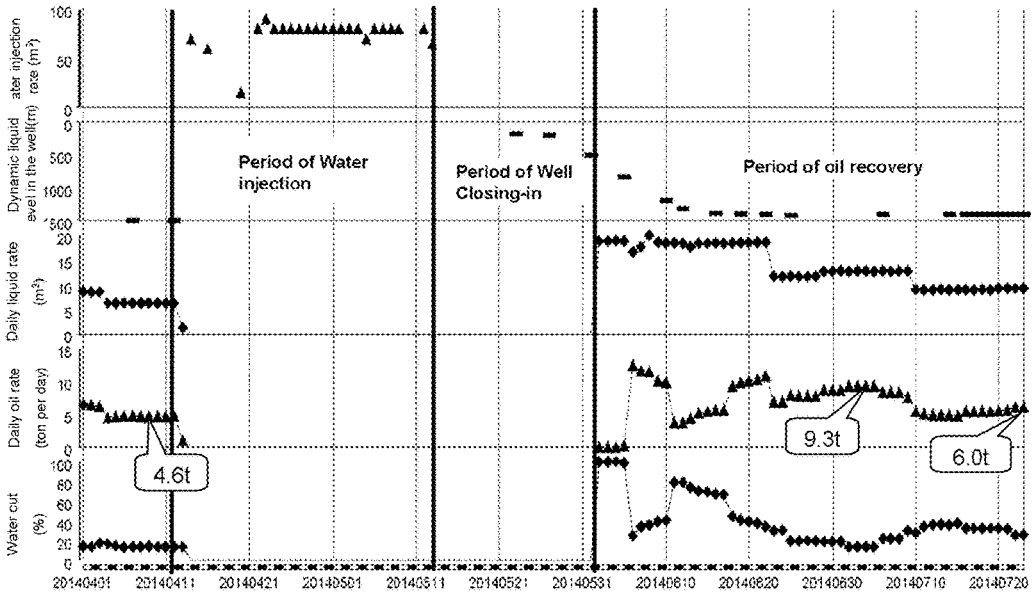

FIG. 9: A graph of the waterflood huff-puff production of Anping No. 19 well.

Figure 10:
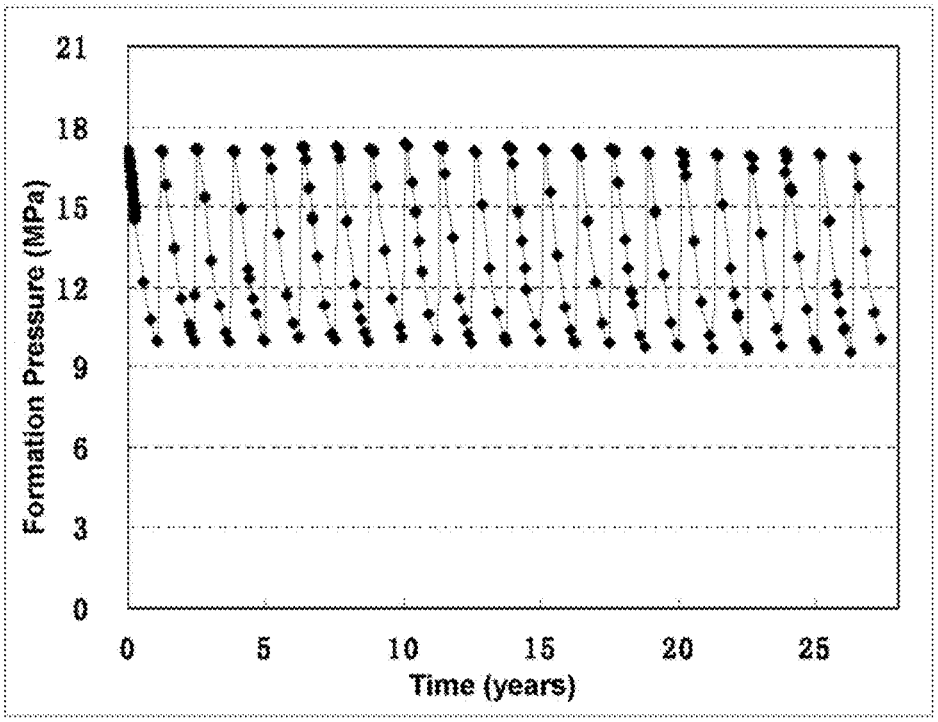

FIG. 10: A graph of the change in the stratum pressure of Anping No. 19 well.

Figure 11:
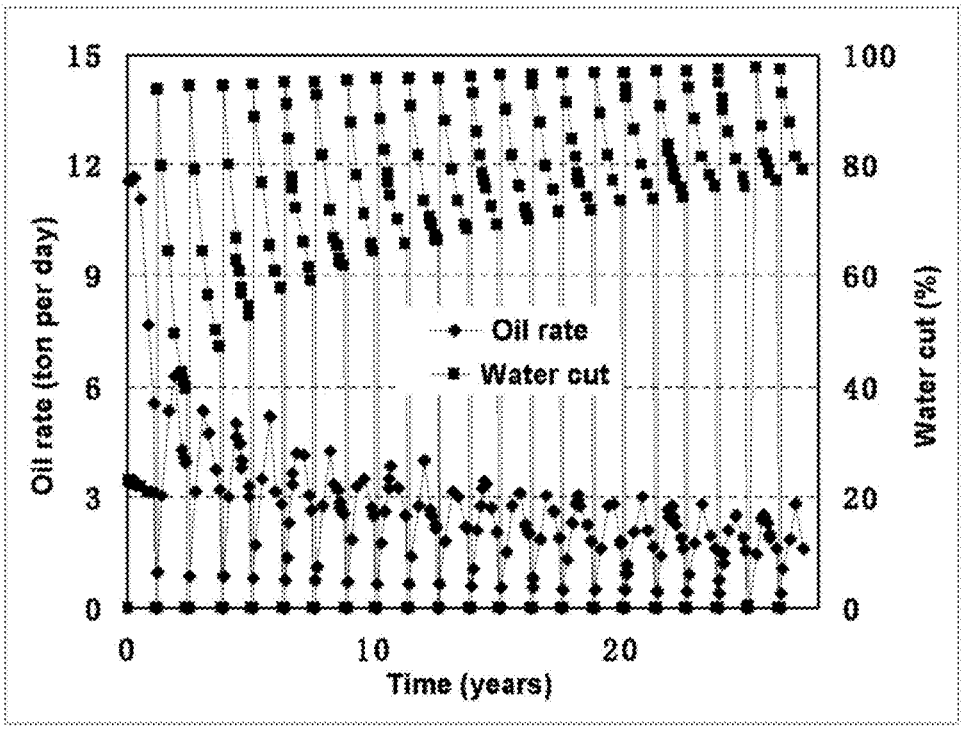

FIG. 11: A graph of the single well production and the water content of Anping No. 19 well.

Figure 12:
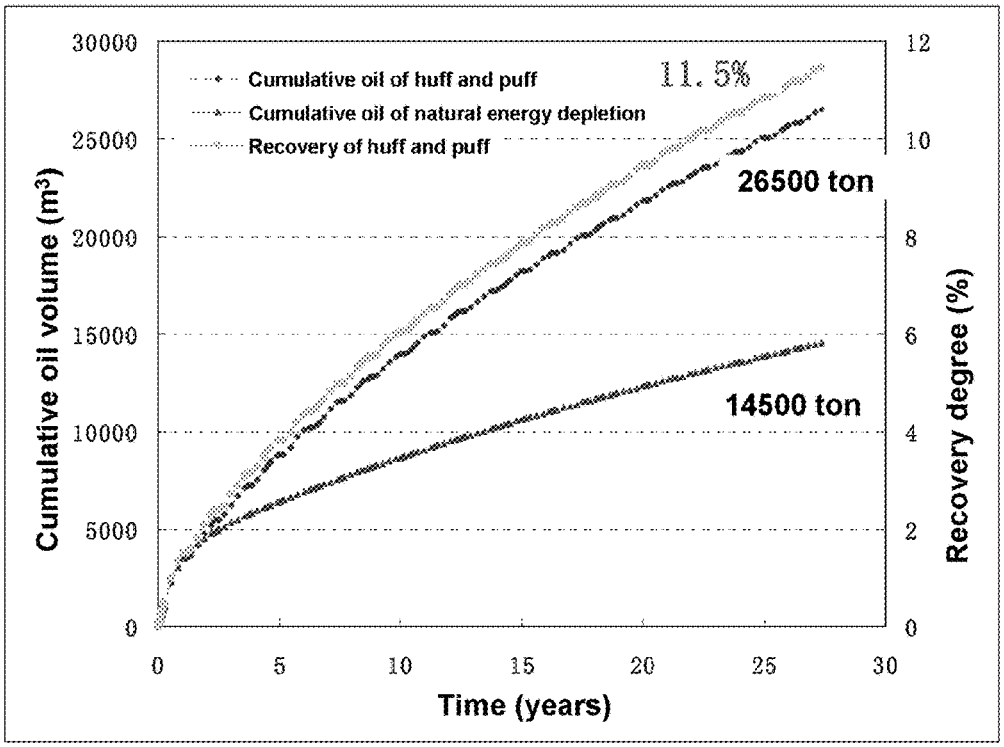

FIG. 12: A graph of the cumulative oil production and the recovery degree of Anping No. 19 well.

Figure 13:
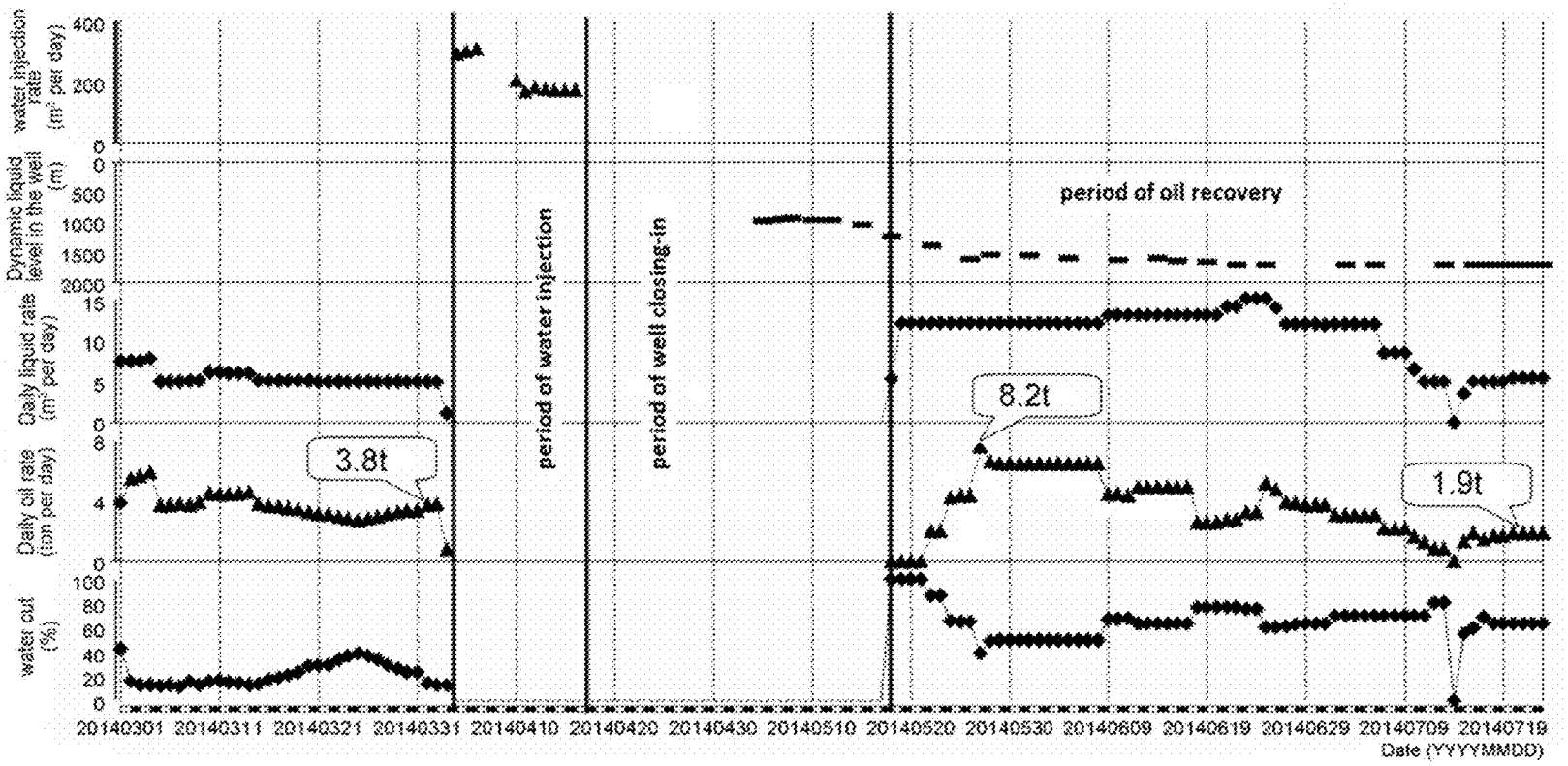

FIG. 13: A graph of the waterflood huff-puff production of Anping No. 21 well group.

DETAILED DESCRIPTION

Example 1

In order to overcome the problem of low recovery rate of the natural energy failure type extraction in the current development of fractured horizontal wells in the tight oil reservoirs, the present invention provides a method for enhancing oil recovery in huff-puff oil production of tight oil from a fractured horizontal well, as shown in FIG. 1. The invention improves the imbibition and oil displacement effect of the fractured tight oil reservoir, improves the infiltration capacity of the low permeability reservoir fractures with the matrix, and increases the recovery degree of the crude oil. It utilizes the horizontal well subjected to the volume fracturing to perform the huff-puff production of tight oil reservoir, fully increases the oil-water contact area in the artificial fractures and natural fractures, and further improves the imbibition and production-enhancing effect of the overall reservoir.

A method for enhancing oil recovery in huff-puff oil production of tight oil from a fractured horizontal well, having the following specific steps:

1) when the reservoir pressure is reduced to 10 MPa, washing the horizontal well by sand flushing, then injecting the water into the reservoir with the specified daily water injection amount to increase the stratum pressure around the horizontal well, and stopping the water injection when the pressure retention level is 100% at end of the water injection period, with the cumulative water injection amount at this time equal to the cumulative liquid recovery amount of the same well in a former production stage;

2) after the completion of water injection, shutting down the horizontal well and starting the huff-puff process of the horizontal well in the reservoir so as to initiate the well-closing stage in which the reservoir crude oil enters the high-permeability channels relying on the imbibition replacement effect;

3) opening the well and starting oil extraction, and shutting down the well when the stratum pressure in the control area of the horizontal well drops to the rated pressure, to perform the second cycle of water injection, well-closing and oil extraction process.

In the present invention, when the reservoir pressure is reduced to 10 MPa, as the best time to inject water into the horizontal wells, the horizontal well is firstly washed by sand flushing, then water is injected into the reservoir with the specified daily water injection amount to increase the stratum pressure around the horizontal well, and the water injection is stopped when the pressure retention level is 100% at end of the water injection period, with the cumulative water injection amount at this time equal to the cumulative liquid recovery amount of the same well in a former production stage; after the completion of water injection, the horizontal well is shut down to initiate the well-closing stage of which the time period is determined by the optimized results of the characteristics of different tight oil reservoirs, and the reservoir crude oil enters the high-permeability channels relying on effects such as imbibition replacement. The well is opened for production, and during the oil extraction, the well is shut down again when the stratum pressure in the control area of the horizontal well drops to the rated pressure, to perform the second cycle of water injection, well-closing and oil extraction process.

In step 1), the optimal timing of the water injection was based on the results of the numerical simulation study (see FIG. 2). With the pressure reduction at the end stage, the oil extraction in a single huff-puff increased, but it is a low-pressure low-yield process in a long time, with a low cumulative production. When the next cycle of huff-puff began at a higher pressure at the end stage, due to short production time, the actual effective oil extraction in a single huff-puff was low, taking into account the impact of water injection and well-closing time and the high water content at the early stage after well opening. The numerical simulation results of multiple cycle of huff-puff show that, with the increase of the pressure at the end stage of the oil extraction, the recovery degree of waterflood huff-puff in Anping No. 19 and Anping No. 21 wells increased first and then decreased. When the stratum pressure at the end of the oil extraction was 10 MPa and the pressure retention level was 59%, the degree of recovery was highest, that is, if the next cycle of waterflood huff-puff was started when the stratum pressure dropped to 10 MPa, the multiple huff-puff had the best effect. According to Fan Zifei horizontal well productivity formula, when the stratum pressure is 10 MPa, the daily liquid production of the horizontal well is 4.0 $m^3$.

In step 1), the optimized values for the pressure retention level at the end of the water injection is 100%, and the cumulative water injection amount is the corresponding cumulative liquid recovery in the previous cycle. Based on the numerical simulation results, with the increase of the cumulative water injection amount, the pressure retention level increases, the single well production in the oil extraction stage decreases, the water content increases, the single cycle oil extraction time increases, and the number of huff-puff cycles decreases within 20 years (see FIGS. 3 and 4). With the increase of cumulative water injection amount, the pressure retention level before the well opening is increased, the production time during the oil extraction becomes longer, the single huff-puff oil production and the water content are also increased, but the number of huff-puff cycles is reduced. When the pressure retention level at the end of the water injection is 100%, the cumulative oil production is the highest and the extraction effect is the best. The cumulative water injection amount can be calculated according to the principle of material balance, wherein the water injection amount is the elastically changed volume of the pores in the stratum. When the pressure retention level rises from 59% before the huff-puff to 100%, the calculated cumulative water injection amount is a cumulative water injection amount for a single huff-puff cycle.

$$\Delta V = C_i \cdot V \cdot \Delta P \quad (1)$$

A large amount of volume fracturing retention fluid is a result of the process of increasing stratum pressure, which can make the stratum pressure increased up to 110-120% of the original pressure. Quasi-natural energy extraction is the process of pressure decreasing, and when the pressure is dropped such that the retention level is 59%, the cumulative yield is the highest, thus the cumulative water injection amount is the compensation amount taking into account the retention liquid.

In step 1), the optimal value of daily water injection amount in a single well is mainly obtained in combination with the preliminary mineral experiments. The preliminary waterflood huff-puff experiments showed that Anping No. 21 well had a high water injection intensity, with an average single-section daily water injection amount of 30 $m^3$, and the injected water rushed into the adjacent wells in 4-5 days, thus the oil-water replacement effect was poor. Anping No.

19 well had a low water injection intensity, with an average single-section daily water injection amount of 8.9 $m^3$, and the injection water rushed into adjacent well after 27 days, with a high pressure retention level (92.3%). To avoid the diffusion of injected water, combined with Anping No. 19 and Anping No. 21 wells water injection dynamic characteristics, the single section daily water injection amount should be 10-20 $m^3$, and the single well daily water injection amount was the sum of the single section daily water injection amounts. Due to the heterogeneity of the reservoirs, each of the sections had different water absorption capacity. From the water absorption profile of the Anping No. 19 well, the water absorption at the first 200 m near the window was 94.2% of the whole well, and the water absorption was only 5.8% for the later 200 m (see FIGS. 5A-E). Thus, it is necessary to perform sectional water injection, to achieve uniform water injection for the whole well.

In step 2), the well-closing time was determined mainly in combination with the production rate of the onsite operation. The results of the numerical simulation study showed that, under the action of capillary force, oil-water displacement occurred between the matrix and the fracture, and the oil saturation of the fracture near the wellbore was increased, and the oil saturation was substantially balanced after 30 days. Although the oil-water displacement would be more sufficient and the cumulative oil production of waterflood huff-puff increased gradually as the well-closing time becomes longer, the increment was low. Considering the production rate of oil well onsite, the well-closing time was optimized as 30 days (see FIG. 6, FIG. 7).

In step 3), when the well was opened for oil extraction, it is necessary to adapt reasonable production parameters. The main production parameters include the end-stage pressure of oil extraction, the cumulative liquid recovery, a reasonable daily liquid recovery and oil extraction days.

(1) Reasonable end-stage pressure of oil extraction. The demonstration methodology was the same as that for the timing of waterflood huff-puff. With the pressure reduction at the end stage, the oil extraction in a single huff-puff increased, but it is a low-pressure low-yield process in a long time, resulting in a low cumulative production. When the next cycle of huff-puff began at a higher pressure at the end stage, due to short production time, the actual effective oil extraction in a single huff-puff was low, taking into account the impact of water injection and well-closing time and the high water content at the early stage after well opening. Thus, there must be a reasonable end-stage pressure. According to the waterflood huff-puff timing demonstration, a reasonable pressure was 10 MPa, and the pressure retention level was 59%.

(2) Under the reasonable end-stage pressure of oil extraction, the cyclic liquid recovery, i.e., the cumulative liquid recovery can be obtained. The initial-stage pressure of oil extraction was 16.9 MPa, dropped down to the end-stage pressure of 10 MPa. According to the principle of material balance and the relationship between the cumulative output and pressure difference, the cumulative liquid recovery can be calculated. The cumulative liquid amount produced by multi-cycle waterflood huff-puff was equal to the cumulative water injection amount.

(3) Reasonable daily liquid recovery and oil extraction time. The dynamics of the volume fractured horizontal well for tight oil with a longer production time showed that, the oil recovery rate has a large effect on the annual decrease and cumulative production of the horizontal wells (see FIG. 8). The An 83 well block had an average initial-stage single well production of 10.4 t/d, an oil recovery rate of 1.5%, and an annual decrease of up to 43%. When the initial-stage oil recovery rate was 1%, the annual decrease can be reduced to 30%. The production mechanism of the waterflood huff-puff oil extraction was similar with that in the initial stage of the volume fractured horizontal well; in order to reduce the decrease, the average oil recovery rate of the wells subjected to the waterflood huff-puff test was controlled at about 1%, and the average daily liquid production is 10 $m^3$. The water content was high at initial stage of oil extraction after the well was opened; in order to reduce energy loss, the initial production was conducted under liquid controlling, with the liquid volume not exceeding 15 $m^3$.

The main contradiction to which the method for oil production of tight oil from a fractured horizontal well of the present invention is directed to is the influence of the high pressure in the wellbores and the water injection on the ground and the oil pipeline flow switching during the periodic water injection. Thus, the horizontal wells are required to have an improved wellbore and better cementing conditions, while the equipment for water injection on the ground can ensure sufficient water injection capacity and quick switching mode.

The method for oil production of tight oil from a fractured horizontal well of the present invention utilizes the imbibition replacement action between the injected water and the crude oil in the tight reservoir rock at the time of the huff-puff, of which the mechanism for the production increase mainly includes the following aspects:

(1) the fractured low permeability reservoir which is difficult to be utilized by conventional water injection can make full use of the reverse imbibition action of the matrix through the periodic waterflood huff-puff, to replace the crude oil in matrix rock block into the fractures for extraction.

(2) The indoor and mineral experimental study shows that the characteristics of fracture extraction in tight oil reservoir, reservoir rock porosity and seepage characteristics are beneficial to improve the imbibition and oil displacement of fractured tight oil reservoirs, improve the infiltration capacity of the low permeability reservoir fractures with the matrix, and increase the degree of crude oil recovery.

(3) The volume fractured horizontal wells are used for huff-puff oil extraction for the tight oil reservoirs, thereby the oil-water contact area in the artificial fractures and natural fractures in the reservoir are fully increased, and the imbibition and production-enhancing effect of the whole oil reservoir is further increased.

The present invention is directed to a tight oil reservoir which is difficult to extract with conventional water injection or gas injection and developed with natural fractures; at the same time, in order to further improve the production-enhancing effect, it is mainly directed to the fractured horizontal wells which are prone to water-logging after volume fracture, so as to improve the oil recovery of the huff-puff oil extraction.

The invention provides an effective way to improve recovery for the tight oil extraction through the study on waterflood huff-puff oil extraction of the tight oil from a fractured horizontal well. At the same time, the method for oil production of tight oil from a fractured horizontal well has substantial production-enhancing effect, low investment cost, good economic benefit, and much lower technical and economic risk than the gas huff-puff, microbial huff-puff or chemical huff-puff.

Example 2

Similarly with the above-described Example, in the present Example, the reservoir had a single layer of reservoir with a thickness of 2-100 m, an average permeability of the reservoir matrix of generally less than 0.3 mD, an average porosity of 9% and an average fracture density of 0.29/m; and the reservoir type was an unsaturated, low pressure reservoir with no bottom water/gas top.

The well in the reservoir was a horizontal well with a horizontal section of 850 m and a well spacing of 600 m; the well was a well subjected to sectional fracturing modification and having an average fracture construction displacement of >6 $m^3$/min, and an average fractured section interval of 80-100 m, when the well completed and casing cemented.

The pressure at the end of the oil extraction in step 3) was 10 MPa and the pressure retention level was 59%.

In the step 1), in the water injection stage, the daily water injection amount, as obtained from numerical simulation studies and mineral experiment analysis, was a single-section daily water injection amount of 10-20 $m^3$, and the single-well daily water injection amount was the sum of each single-section daily water injection amount.

In the step 1), according to the material balance principle, the cumulative injection amount was the elastically changed volume of the pores in the stratum, and the cumulative water injection amount as calculated at the time when the pressure retention level rises from a low level before the huff-puff to 100% was a cumulative water injection amount for a single huff-puff cycle.

In the step 2), in the huff-puff process of horizontal well in the tight oil reservoir, the well-closing time was 30 days.

In the step 3), because of high water content at the initial stage of the well opening and oil extraction, the initial-stage production was conducted by controlling the liquid with a liquid volume of not exceeding 15 $m^3$ to reduce energy loss.

The cycle of water injection, the well-closing and oil extraction process was repeated for 1-5 times.

The invention provides an effective way to increase the oil recovery for the extraction of tight oil through the research on the extraction by waterflood huff-puff in the tight oil fracturing horizontal well. At the same time, the method for huff-puff oil production of tight oil from a fractured horizontal well has an significant production-enhancing effect, a low investment cost, a good economic benefit, and a much lower technical and economic risk than that of gas huff-puff, microbial huff-puff or chemical huff-puff.

Example 3

The present Example is mainly directed to the tight oil reservoirs in the Xin'anbian area of the Ordos Basin. The area is one of the tight oil test zones in Changqing Oilfield. The tight oil reservoir is Chang 7 reservoir and the reservoir depth is 2190-2570 m. The reservoir property is poor (the average porosity obtained by core analysis is 8.9% and the average permeability is 0.12 mD). The original stratum pressure is low (average original stratum pressure is 15.8 MPa, and the average pressure coefficient is 0.81). The productivity of the conventional fracturing straight well is low, resulting in the ineffective development and utilization. The Chang $7_2$ reservoir in this area has an average reservoir thickness of 10 m, a porosity by core analysis of 7%-9% (with an average of 8.9%) a permeability of 0.1-0.2 mD (with an average of 0.12 mD), developed natural fractures with an average fracture development density of 0.29/m, a stratum crude oil viscosity of 1.23 mPa·s, a density of 0.74 g/$cm^3$, a gas to oil ratio of 75.40 $m^3$/t, and a saturation pressure of 7.04 MPa. According to the comprehensive analysis, it is found that the reservoir has poor oil-bearing property, and the pore and seepage conditions are in the lower limit of conventional extraction. At present, the reservoir is mainly extracted by volume fractured horizontal well in a manner of natural energy failure type extraction.

Anping No. 19 is a developed horizontal well in the area, of which the drilling was finished in September 2012. The drilled layer was in Chang $7_2$ reservoir, with a horizontal section length of 435 m, and a reservoir-encountered rate of 97.2%. Using sectional volume fracturing transformation process, 9 sections were obtained by the fracturing transformation, with an average single-section construction displacement of 4 $m^3$/min, and an average single-section sand-adding amount of 40 $m^3$. The well was put into operation in November 2012, with an oil production of 12.3 t/d and a water content of 19.2% at the initial stage of production. In Apr. 10, 2014, the well was shut down to initiate the waterflood huff-puff, and the oil production was 4.6 t/d with a water content of 19.5% before the huff-puff. It can be seen that the yield of the horizontal well decreases greatly by the failure type oil extraction.

Anping No. 19 well was washed by sand flushing on Apr. 17, 2014, and subjected to water injection from Apr. 20, 2014, with a single well daily water injection amount of 80 $m^3$, a cumulative water injection amount of 1800 $m^3$ in 22 days for water injection. Then the well was shut down for well-closing for a period of 19 days, during with the stratum pressure as actually measured increased from 10.5 MPa to 15.6 MPa, and the stratum pressure retention level was high. The well was opened on Jun. 1, 2014. The water content gradually decreased after the well was opened, and the oil emerged after 5 days, with the working fluid level dropped from 202 m down to 827 m, the daily oil production increased from 4.6t before the experiment to 10.3t, and an effective oil production-enhancing period of 117 days (FIG. 9), which is a remarkable effect.

In order to further analyze the effect of waterflood huff-puff for extraction, the numerical simulation technology was used to predict the oil extraction for waterflood huff-puff in the horizontal well: under the conditions that the injection amount in a huff-puff cycle was 4663 $m^3$, the pressure reached 100% of the original stratum pressure, and the well is closed for 1 month, after 27-year extraction having 20 cycles each having an extraction period of 417 days, the recovery rate for the waterflood huff-puff was 11.5%, with a single-well cumulative oil production of $2.65\times10^4$t, which means an excellent extraction effect (see FIG. 10, FIG. 11 and FIG. 12). Anping No. 19 well was designed such that the pressure retention level is 100%, and the cumulative water injection amount was 4663 $m^3$. At the initial stage, the production is conducted by controlling the liquid with a liquid volume of not exceeding 15 $m^3$, and the effective time for oil extraction can be up to 1 to 2 years (Table 1).

TABLE 1

The parameter design and prediction form for waterflood huff-puff in Anping No. 19

| Items | Value |
|---|---|
| Length of the horizontal segment (m) | 645 |
| Control area of the horizontal well ($km^2$) | 0.36 |
| Daily water injection amount during waterflood huff-puff ($m^3$) | 150 |
| Water injection period during waterflood huff-puff (d) | 31 |
| Cumulative water injection amount during waterflood huff-puff ($m^3$) | 4663 |
| End-stage pressure of waterflood huff-puff (MPa) | 16.9 |
| End-stage stratum pressure level of waterflood huff-puff (%) | 100 |
| Closing time in well-closing (d) | 30 |

TABLE 1-continued

The parameter design and prediction form for waterflood huff-puff in Anping No. 19

| Items | Value |
|---|---|
| Oil extraction time during the production stage (d) | 417 |
| Cumulative liquid production amount during the production stage ($m^3$) | 4510 |
| Daily liquid production amount during the production stage ($m^3$) | 15 |
| End-stage pressure of the production (MPa) | 10 |
| End-stage pressure level of the production (%) | 56 |

Example 4

Anping No. 21 is a developed horizontal well adjacent to Anping No. 19 well in Example 2 of the area. The drilling of the well was finished in April 2012. The drilled layer was in Chang $7_2$ reservoir, with a horizontal section length of 636 m, and a reservoir-encountered rate of 94.7%. Using sectional volume fracturing transformation process, 6 sections were obtained by the fracturing transformation, with an average single-section construction displacement of 5.9 $m^3$/min, and an average single-section and—adding amount of 35 $m^3$. The well was put into operation in July 2012, with an oil production of 11.9 t/d and a water content of 19.2% at the initial stage of production. In Apr. 2, 2014, the well was shut down to initiate the waterflood huff-puff, and the oil production was 3.8 t/d, with a water content of 20.5% before the huff-puff.

Anping No. 21 well was washed by sand flushing on Apr. 5, 2014, and subjected to water injection on from Apr. 9, 2014, with a designed single well daily water injection amount of 150 $m^3$, an actual single well daily injection amount of 180 $m^3$, a cumulative water injection amount of 2200 $m^3$ (including that for washing by sand flushing of 900 $m^3$). Then the well was closed for 31 days, during with the stratum pressure increased from 8.7 MPa to 12.6 MPa. The well was opened on May 18, 2014, and the oil emerged after 5 days, with the daily oil production increased from 3.8t before the experiment to 8.2t, and an effective oil production-enhancing period of 100 days (FIG. 13).

It can be seen from the studies of mineral experiment and numerical simulation prediction of Example 2 and Example 3 that the method for huff-puff oil production of tight oil from a fractured horizontal well of the present invention is an effective way to develop the tight oil reservoirs.

The above description is only examples of two huff-puff oil productions for tight oil of the present invention. It should be pointed out that, at present, this method has been popularized and applied in the An 83 tight oil block in Anbian area, and the oil production-enhancing effect has been all achieved and the recovery rate of tight oil reservoirs is greatly improved. It will also be apparent to one of ordinary skill in the art that various modifications and substitutions may be made in view of different reservoir features and well types without departing from the technical principles of the present invention, and these improvements and substitutions should also be considered within protection scopes of the present invention.

Unless otherwise specified, the technical means used in the embodiments are conventional means known to those skilled in the art.

What is claimed is:

1. A method for enhancing oil recovery in huff-puff oil production of tight oil from a fractured horizontal well, the method comprising:

1) when a reservoir pressure is reduced to 10 MPa, washing the horizontal well by sand flushing, then injecting water into a reservoir with a specified daily water injection amount to increase a stratum pressure around the horizontal well, and stopping the water injection when a pressure retention level is 100% at end stage of a water injection period, with a cumulative water injection amount at this time equal to a cumulative liquid recovery amount of the horizontal well in a former production stage;

2) after a completion of water injection, shutting down the horizontal well and starting a huff-puff process of the horizontal well in the reservoir so as to initiate a well-closing stage in which reservoir crude oil enters a high-permeability channels relying on an imbibition replacement effect;

3) opening the well and starting oil extraction, and shutting down the well when the stratum pressure in a control area of the horizontal well drops to a rated pressure, to perform a second cycle of water injection, well-closing and oil extraction process.

2. The method for enhancing oil recovery in huff-puff oil production of tight oil from a fractured horizontal well according to claim 1, wherein the reservoir is a single-layer reservoir with a thickness of 2-100 m, and reservoir matrix has an average permeability of less than 0.3 mD, an average porosity of 9% and an average fracture density of 0.29/m.

3. The method for enhancing oil recovery in huff-puff oil production of tight oil from a fractured horizontal well according to claim 2, wherein the well of the reservoir is a horizontal well with a horizontal section of 850 m and a well spacing of 600 m, and the well is a well subjected to sectional volume fracturing modification and having an average fracture construction displacement of >6 $m^3$/min, and an average fractured section interval of 80-100 m, when the well is completed and casing cemented.

4. The method for enhancing oil recovery in huff-puff oil production of tight oil from a fractured horizontal well according to claim 1, wherein a pressure at the end of the oil extraction in step 3) is 10 MPa and the pressure retention level is 59%.

5. The method for enhancing oil recovery in huff-puff oil production of tight oil from a fractured horizontal well according to claim 1, wherein in step 1), in a water injection stage, the daily water injection amount is a single-section daily water injection amount of 10-20 $m^3$, and a single-well daily water injection amount is a sum of each single-section daily water injection amount.

6. The method for enhancing oil recovery in huff-puff oil production of tight oil from a fractured horizontal well according to claim 1, wherein in step 1), the cumulative injection amount is a elastically changed volume of pores in a stratum, and the cumulative water injection amount as calculated at a time when the pressure retention level rises from a low level before the huff-puff to 100% is a cumulative water injection amount for a single huff-puff cycle.

7. The method for enhancing oil recovery in huff-puff oil production of tight oil from a fractured horizontal well according to claim 1, wherein in step 2), in the huff-puff process of the horizontal well in the reservoir, the well-closing stage is 30 days.

8. The method for enhancing oil recovery in huff-puff oil production of tight oil from a fractured horizontal well according to claim 1, wherein in step 3), a water content is high after the completion of water injection, relative to normal conditions at an initial stage of the well opening and oil extraction, and an initial-stage production is conducted by controlling a daily liquid volume of not exceeding 15 $m^3$.

9. The method for enhancing oil recovery in huff-puff oil production of tight oil from a fractured horizontal well according to claim 1, wherein the cycle of water injection, well-closing and oil extraction process is repeated for 1-5 times.

* * * * *